United States Patent [19]

Nothnagle

[11] 4,269,929

[45] May 26, 1981

[54] HIGH CONTRAST DEVELOPMENT OF PHOTOGRAPHIC ELEMENTS

[75] Inventor: Ronald J. Nothnagle, Rochester, N.Y.

[73] Assignee: Eastman Kodak Company, Rochester, N.Y.

[21] Appl. No.: 112,249

[22] Filed: Jan. 14, 1980

[51] Int. Cl.[3] ..... G03C 5/30

[52] U.S. Cl. ..... 430/264; 430/265; 430/267; 430/268; 430/438; 430/481; 430/486; 430/490; 430/599; 430/949

[58] Field of Search ..... 430/949, 264–268, 430/599, 486, 490, 438, 481

[56] References Cited

U.S. PATENT DOCUMENTS

| | | | |
|---|---|---|---|
| Re. 26,601 | 6/1969 | Allen | 430/489 |
| 2,410,690 | 11/1946 | Smith . | |
| 2,419,974 | 5/1947 | Stauffer . | |
| 2,419,975 | 5/1947 | Trivelli . | |
| 2,882,152 | 4/1959 | Dickerson | 96/66 |
| 2,892,715 | 6/1959 | Hunsberger . | |
| 3,573,914 | 4/1971 | Masseth | 96/66.4 |
| 3,782,949 | 1/1974 | Olivares | 430/484 |
| 3,793,027 | 2/1974 | Okutsu | 430/265 |
| 4,022,621 | 5/1977 | Hayashi | 430/268 |
| 4,166,742 | 9/1979 | Mifune | 430/949 |
| 4,168,977 | 9/1979 | Takada | 430/949 |
| 4,172,728 | 10/1979 | Sincius | 430/268 |

FOREIGN PATENT DOCUMENTS 1359444 7/1974 United Kingdom .

*Primary Examiner*—Mary F. Downey
*Attorney, Agent, or Firm*—A. P. Lorenzo

[57] ABSTRACT

High contrast development of photographic elements, such as lithographic films used in the field of graphic arts, is carried out in the presence of a hydrazine compound with an aqueous alkaline developing solution which has a pH of above 10 and below 12 and contains a dihydroxybenzene developing agent, a 3-pyrazolidone developing agent, a sulfite preservative, and a contrast-promoting amount of an amino compound. The developing solution combines the advantages of high capacity, a high degree of stability, and a long effective life, while providing excellent contrast and speed characteristics.

25 Claims, No Drawings

HIGH CONTRAST DEVELOPMENT OF PHOTOGRAPHIC ELEMENTS

This invention relates in general to photography and in particular to the black-and-white development of photographic elements. More specifically, this invention relates to the development of high contrast photographic elements, such as lithographic films used in the field of graphic arts.

High contrast development of lithographic films is ordinarily carried out using special developers which are known in the art as "lith" developers. In conventional "lith" developers, high contrast is achieved using the "lith effect" (also referred to as infectious development) as described by J. A. C. Yule in the Journal of the Franklin Institute, Vol. 239, 221–230, (1945). This type of development is believed to proceed autocatalytically. To achieve "lith effect" development, a low, but critical, concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Conventional "lith" developers suffer from serious deficiencies which restrict their usefulness. For example, the developer exhibits low capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, a conventional "lith" developer is lacking in stability and tends to give erratic results depending on the length of time that it has been exposed to the air.

As an alternative to using a hydroquinone developer with a low sulfite content to achieve high contrast development, it is possible to utilize a hydrazine compound, either in the photographic element or in the developer solution, which will promote high contrast. As described in Simson et al, U.S. patent application Ser. No. 57,042, "High Contrast Photographic Emulsions And Elements And Processes For Their Development," filed July 12, 1979, as a continuation of U.S. Pat. application Ser. No. 944,940 filed Sept. 22, 1978, use of a hydrazine compound permits the use of auxiliary developing agents in combination with the dihydroxybenzene developing agent in order to increase development capacity. It also permits the use of relatively high sulfite concentrations to protect the developing agents against oxidation and thereby increase developer stability. However, high pH levels in developers containing hydrazine compounds, or in developers used with photographic elements, such as those of Simson et al, which contain hydrazine compounds, for example a pH of 12.0, are desirable in order to get the maximum improvement in contrast from the use of the hydrazine compound. The use of such high pH levels means that the effective life of the developing solution is relatively short. It would, accordingly, be highly advantageous to provide a developing solution that provides the advantage of a long effective working life in addition to the advantages of high capacity and a high degree of stability.

In accordance with this invention, it has been discovered that the above advantage is achieved by the use of an aqueous alkaline developing solution which contains a combination of developing agents that gives good capacity, namely a combination of a dihydroxybenzene developing agent and a 3-pyrazolidone developing agent; which contains a hydrazine compound, or is utilized with a photographic element containing a hydrazine compound, to obtain the beneficial effects which such compounds exert on contrast characteristics; which contains a sulfite preservative at a level sufficient to provide good stability characteristics; which contains an amino compound in an amount which is sufficient to promote contrast; and which utilizes a reduced pH level, that is a pH of below 12, to thereby enhance the effective life of the solution. Quite unexpectedly, it has been found that the amino compound permits the use of a reduced pH level, while retaining the desired high contrast characteristics, and thereby achieves the important objective of prolonging the effective life of the developer, that is, of increasing the length of time that the developer can be stored and/or used and still provide acceptable development characteristics.

It is well known to use hydrazine compounds, either in photographic developers or in a photographic element, to promote high contrast development. Thus, for example, such use of hydrazine compounds is described in Smith et al U.S. Pat. No. 2,410,690, Stauffer et al U.S. Pat. No. 2,419,974, Trivelli et al U.S. Pat. No. 2,419,975 and Hunsberger U.S. Pat. No. 2,892,715, and in an article by Stauffer, Smith and Trivelli entitled, "The Influence Of Photographic Developers Containing Hydrazine Upon The Characteristic Curves of Photographic Materials," Journal of the Franklin Institute, Vol. 238, pages 291–298, October 1944. It is also well known to use amino compounds in developers employed in high contrast development. Such compounds have been used for a variety of purposes such as the use for the purpose of increasing stability and reducing drag streaks and dot distortions described in Masseth U.S. Pat. No. 3,573,914; the use in combination with a carbonylbisulfite and a carbonate to achieve stability and good dot quality described in Hayashi et al U.S. Pat. No. 4,022,621; the use as an agent which aids in dissolving dihydroxybenzene developers and which promotes dot quality and avoids contraction of half-tone gradation described in British Pat. No. 1,359,444 published July 10, 1974; and the use as a pH controlling agent described in Sincius et al, U.S. Pat. No. 4,172,728. It is also known from Dickerson U.S. Pat. No. 2,882,152 to utilize a combination of hydrazine and triethanolamine in a black-and-white developing composition as a development accelerator. However, it is not known to the prior art to utilize both an amino compound and a hydrazine compound to promote the formation of high contrast at reduced pH levels, as described herein, and this novel combination of features has been surprisingly found to provide a highly desirable combination of advantageous characteristics in high contrast processing, namely the combination of high capacity, a high degree of stability, and a long effective life.

In the method of this invention, the amino compound must be used in a contrast-promoting amount. Such use of an amino compound is distinct from the use of certain amino compounds, such as ethylenediaminetetraacetic acid, as chelating or sequestering agents, as is disclosed in the aforesaid Simson et al patent application Ser. No. 57,042. Ethylenediaminetetraacetic acid is used in small amounts, such as amounts of about one gram per liter of developer solution, for the purpose of functioning as a chelating or sequestering agent, but use of such small amounts of ethylene-diaminetetraacetic acid has no significant contrast-promoting effect. In the present invention, in which an amino compound is employed to promote contrast, it will usually be desirable to also include ethylene-diaminetetraacetic acid, or other similar chelating or sequestering agent, in the developing solution, in order to sequester calcium ions, and thereby prevent the formation of undesirable precipitates.

Photographic elements which can be processed in the novel high contrast developing solutions of this invention are not limited to "lith" films. Typically, "lith" films contain high chloride emulsions (at least about 60 percent by weight silver chloride based on total silver halide), most usually in the form of silver chlorobromides or silver chlorobromoiodides. Such films give excellent results when used in the novel high contrast developing solutions of this invention. However, the novel high contrast developing solutions of this invention can also be usefully employed with other types of silver halide photographic elements, for example with elements utilizing silver bromide or silver bromoiodide emulsions. To achieve the benefits of this invention, the hydrazine compound can be incorporated in the photographic element or in the developing solution, the essential requirement being that it be present during development of the exposed element. Incorporation of a hydrazine compound in both the photographic element and in the developing solutions is, of course, a further alternative that can be utilized where it is desired to do so.

The contrast or "gamma" of a photographic element refers to the rate of change of density with exposure and is measured by the slope of the straight line portion of the characteristic curve. Photographic elements processed in the novel developing solutions of this invention typically exhibit very high contrast, by which is meant a gamma of greater than 10.

As used herein, the term "a hydrazine compound" is intended to include hydrazine and hydrazine derivatives, including those which are suited for incorporation in developing solutions and those which are suited for incorporation in photographic elements.

Hydrazine ($H_2N\text{-}NH_2$) is an effective contrast-promoting agent which can be incorporated in the developing solutions of this invention. As an alternative to the use of hydrazine, any of a wide variety of water-soluble hydrazine derivatives can be added to the developing solution. Preferred hydrazine derivatives for use in the developing solutions of this invention include organic hydrazine compounds of the formula:

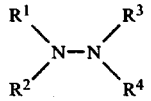

where $R^1$ is an organic radical and each of $R^2$, $R^3$ and $R^4$ is a hydrogen atom or an organic radical. Organic radicals represented by $R^1$, $R^2$, $R^3$ and $R^4$ include hydrocarbyl groups such as an alkyl group, an aryl group, an aralkyl group, an alkaryl group, and an alicyclic group, as well as hydrocarbyl groups substituted with substituents such as alkoxy groups, carboxy groups, sulfonamido groups, and halogen atoms.

Particularly preferred hydrazine derivatives for incorporation in the developing solutions of this invention include alkylsulfonamido aryl hydrazines such as p-(methylsulfonamido) phenylhydrazine and alkylsulfonamidoalkyl aryl hydrazines such as p-(methylsulfonamidomethyl) phenylhydrazine.

In the practice of this invention, it is preferred that the hydrazine compound be incorporated in the photographic element. For example, it can be incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers, and overcoating layers.

Photographic elements which are particularly preferred for use in the method of this invention include elements described in the aforesaid Simson et al U.S. Pat. application Ser. No. 57,042, the disclosure of which is incorporated herein by reference. These elements contain a hydrazine compound of the formula:

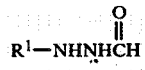

wherein $R^1$ is a phenyl nucleus having a Hammet sigma value-derived electron withdrawing characteristic of less than +0.30.

As disclosed in Simson et al U.S. Pat. application Ser. No. 57,042, $R^1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron withdrawing substituents are assigned negative sigma values. For example, in one preferred form $R^1$ can be a phenyl group which is unsubstituted. The hydrogens attached to the phenyl ring each have a Hammett sigma value of 0 by definition. In another form, the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of specifically preferred hydrazine compounds disclosed in Simson et al U.S. Pat. application Ser. No. 57,042 are the following:

1-Formyl-2-{4-[2-(2,4-di-tert-pentylphenoxy)-butyramido]phenyl}hydrazine

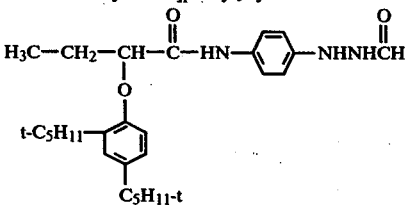

1-Formyl-2-phenylhydrazine

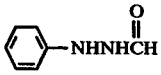

1-Formyl-2-(4-methoxylphenyl)hydrazine

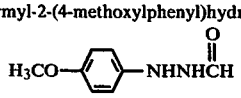

1-Formyl-2-(4-chlorophenyl)hydrazine

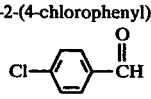

1-Formyl-2-(4-fluorophenyl)hydrazine

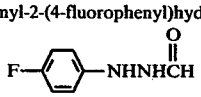

1-Formyl-2-(2-chlorophenyl)hydrazine

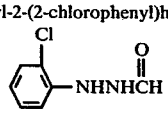

1-Formyl-2-(p-tolyl)hydrazine

-continued

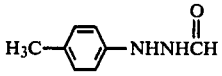

Preferred photographic elements for use in the method of this invention also include those in which the hydrazide comprises an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea

3-[4-(2-formylhydrazino)phenyl]-5-(3-methyl-2-benzoxazolinylidene)rhodanine-6-{[4-(2-formylhydrazino)-phenyl]ureylene}-2-methylbenzothiazole N-(benzotriazol-5-yl)-4-(2-formylhydrazino)-phenylacetamide N-(benzotriazol-5-yl)-3-(5-formylhydrazino-2-methoxyphenyl)propionamide and N-2-(5,5-dimethyl-2-thioimidazol-4-yl-idinimino)ethyl-3-[5-(formylhydrazino)-2-methoxyphenyl]propionamide.

Hydrazine compounds incorporated in the developing solution in the practice of this invention are effective at very low levels of concentration. For example, hydrazine gives effective results in the developing solution in an amount of only 0.1 grams per liter. Hydrazine compounds incorporated in the photographic element, as described in Simson et al U.S. Pat. application Ser. No. 57,042, are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver. The hydrazides containing an adsorption promoting moiety can be used at a level as low as about $5\times10^{-6}$ mole per mole of silver.

The dihydroxybenzene developing agents employed in the aqueous alkaline developing solutions of this invention are well known and widely used in photographic processing. The preferred developing agent of this class is hydroquinone. Other useful dihydroxybenzene developing agents include:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone,
2,5-diacetaminohydroquinone,
and the like.

The 3-pyrazolidone developing agents employed in the aqueous alkaline developing solutions of this invention are also well known and widely used in photographic processing. Preferred developing agents of this class are those represented by the formula:

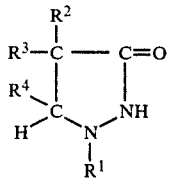

in which $R^1$ is aryl (including substituted aryl) and $R^2$, $R^3$, and $R^4$ are hydrogen or alkyl (including substituted alkyl). Included within the definition of $R^1$ are phenyl and phenyl substituted with groups such as methyl, chloro, amino, methylamino, acetylamino, methoxy and methylsulfonamidoethyl. Included within the definition of $R^2$, $R^3$ and $R^4$ are unsubstituted alkyl and alkyl substituted with groups such as hydroxy, carboxy, or sulfo. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include:

1-phenyl-5-methyl-3-pyrazolidone,
1-phenyl-4,4-dimethyl-3-pyrazolidone,
1-p-aminophenyl-4-methyl-4-propyl-3-pyrazolidone,
1-p-chlorophenyl-4-methyl-4-ethyl-3-pyrazolidone,
1-p-acetamidophenyl-4,4-diethyl-3-pyrazolidone,
1-p-betahydroxyethylphenyl-4,4-dimethyl-3-pyrazolidone,
1-p-hydroxyphenyl-4,4-dimethyl-3-pyrazolidone,
1-p-methoxyphenyl-4,4-diethyl-3-pyrazolidone,
1-p-tolyl-4,4-dimethyl-3-pyrazolidone,
and the like.

The aqueous alkaline photographic developing compositions of this invention contain a sulfite preservative at a level sufficient to protect the developing agents against aerial oxidation and thereby promote good stability characteristics. Useful sulfite preservatives include sulfites, bisulfites, metabisulfites, and carbonyl bisulfite adducts. Typical examples of sulfite preservatives include:

sodium sulfite,
potassium sulfite,
lithium sulfite,
ammonium sulfite,
sodium bisulfite,
potassium metabisulfite,
sodium formaldehyde bisulfite,
and the like.

In accordance with this invention, an amino compound is incorporated in the aqueous alkaline developing solution in a contrast-promoting amount. This use of an amino compound is based upon the discovery that high contrast development in the presence of a hydrazine compound can be accomplished at lower pH levels if the developer solution contains an adequate quantity of an amino compound, as compared to the pH level needed to achieve the same contrast without the use of the amino compound. The advantages of being able to carry out development at lower pH levels will be readily apparent to those skilled in the art of photographic processing. For example, with the use of a lower pH level, the developing solution is much less hazardous and its effective life is greatly enhanced.

The term "an amino compound," as used herein, is intended to refer to any compound having amino functionality. Thus, compounds like o-aminobenzoic acid and o-aminobenzyl alcohol are referred to herein as amino compounds even though they might otherwise be referred to, respectively, as an acid and an alcohol.

Amino compounds useful as contrast-promoting agents in accordance with this invention are compounds of widely varying structure and properties. For example, useful amino compounds include both inorganic amines, such as the hydroxylamines, and organic amines. The organic amines can be aliphatic amines, aromatic amines, cyclic amines, mixed aliphatic-aromatic amines, or heterocyclic amines. Primary, secondary and tertiary amines, as well as quaternary ammonium compounds, have all proven to be effective.

A preferred class of amino compounds are the alkanolamines, this term being used herein to refer to an amine in which the nitrogen atom is directly attached to a hydroxyalkyl radical, i.e., the amine comprises an >N—X—OH group wherein X is alkylene. The radicals attached to the free bonds in the >N—X—OH group can be hydrogen atoms or organic radicals, e.g., unsubstituted hydrocarbon radicals or substituted hydrocarbon radicals. They are preferably hydrogen atoms or hydrocarbyl radicals of 1 to 12 carbon atoms, for example, alkyl, aryl, alkaryl or aralkyl radicals.

Particularly preferred alkanolamines for the purposes of this invention are compounds of the formula:

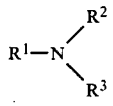

wherein $R^1$ is an hydroxyalkyl group of 2 to 10 carbon atoms and each of $R^2$ and $R^3$ is a hydrogen atom, an alkyl group of 1 to 10 carbon atoms, an hydroxyalkyl group of 2 to 10 carbon atoms, a benzyl radical, or a

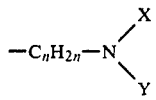

group wherein n is an integer of from 1 to 10 and each of X and Y is a hydrogen atom, an alkyl group of 1 to 10 carbon atoms, or an hydroxyalkyl group of 2 to 10 carbon atoms.

A further preferred class of amino compounds are the alkyl amines, especially those of the formula:

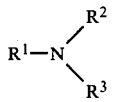

wherein $R^1$ is an alkyl group of 1 to 10 carbon atoms and each of $R^2$ and $R^3$ is a hydrogen atom or an alkyl group of 1 to 10 carbon atoms.

Typical specific examples of the numerous amino compounds that can be used in the practice of this invention include the following:

2-(2-Aminoethylamino)ethanol
Tetramethylammonium acetate

Choline
Choline Chloride
Hydroxylamine sulfate
Triethanolamine
Diethanolamine
Ethanolamine
Trimethylamine
2-Diethylamino-1-ethanol
2-Methylamino-1-ethanol
3-Dimethylamino-1,2-propanediol
3-Diethylamino-1-propanol
5-Amino-1-pentanol
Diethylamine
Methylamine
Triethylamine
Dipropylamine
Di-isopropylamine
3,3'-Diaminodipropylamine
3-Dimethylamino-1-propanol
Hydantoic Acid
Allylamine
Ethylamine
Dimethylamine
Ethylenediamine
2-Dimethylaminoethanol
2-Ethylaminoethanol
$R_1—S—CH_2—CH_2—S—CH_2—CH_2—S—R_1$
$2C_7H_7SO_3^-$
$R_1{=}(CH_3)_2N^+—CH\ CHOHCH_2—$
Dimethylaminodecane-N-ammonium bromide
Ammonium Sulfate
2-[2-Aminoethylamino)-ethylamino]-ethanol
Aminoguanidine Sulfate
6-Aminohexanoic Acid
3-Amino-1-propanol
1-Dimethylamino-2-propanol
2-Hydroxy-4-thiadodecyl trimethyl ammonium pts
Pyridine
Glycine
o-Aminobenzoic Acid
Polyethyleneimine
L-(+)-Cysteine Hydrochloride
Benzylamine
2-Amino-1-ethanol
4-Amino-1-butanol
6-Amino-1-hexanol
1-(2-Aminoethyl)piperazine
1-(2-Hydroxyethyl)-4-(2-mercaptoethyl)-piperazine
2-(β-Cyanoethylmercapto)-imidazolinium chloride
7,18-Diaza-6,19-dioxotetracosane-1,24-di(pyridinium perchlorate)
11-Amino Undeconoic Acid
DL-Serine
Morpholine
4-(2-Aminoethyl)morpholine
o-Aminobenzyl alcohol
Quinuclidine
1,4-Cyclohexanebis(methylamine)

The amino compounds differ markedly in their degree of effectiveness as contrast-promoting agents. The less effective amines may have to be used at relatively high concentrations to obtain the desired objective of high contrast at a pH of above 10 and below 12.

The aqueous alkaline developing solutions of this invention can vary widely in regard to the concentration of the various ingredients included therein. Typically, the dihydroxybenzene developing agent is used in an amount of from about 0.045 to about 0.65 moles per liter, more preferably in an amount of about 0.09 to about 0.36 moles per liter; the 3-pyrazolidone developing agent is used in an amount of from about 0.005 to about 0.01 moles per liter, more preferably in an amount of from about 0.001 to about 0.005 moles per liter; the sulfite preservative is used in an amount of from about 0.04 to about 0.80 moles per liter, more preferably in an amount of from about 0.12 to about 0.60 moles per liter; and the amino compound is used in an amount of from about 0.009 to about 0.85 moles per liter, more preferably in an amount of from about 0.009 to about 0.35 moles per liter.

The aqueous alkaline developing solutions of this invention have a pH of above 10 and below 12. To provide a pH in this range, the amino compound which is utilized as a contrast-promoting agent can be employed in an amount sufficient to establish the desired pH. Thus, the amino compound can serve both the function of pH control and the function of promoting the desired high contrast. However, since the amount of amino compound required to give a pH of above 10 is relatively large, and may be far more than the amount needed to provide the desired high contrast, it will often be advantageous to incorporate another alkaline agent, such as an alkali metal hydroxide, or carbonate, in the developing solution in an amount that, together with the amino compound, establishes the desired pH of above 10 and below 12. The preferred pH range for the aqueous alkaline developing solutions of this invention is from 10.8 to 11.4.

In contrast with conventional "lith" developers which require a low level of sulfite ion, the developing solutions of this invention can utilize much higher levels of sulfite ion, and thereby achieve the advantage of increased stability, since the higher level of sulfite ion provides increased protection against aerial oxidation.

In carrying out the method of this invention, it is preferred to employ an organic antifoggant to minimize fog formation. The organic antifoggant can be incorporated in the photographic element or it can be added to the developing solution, the essential requirement being that it be present during the developing process. Particularly advantageous results are achieved with the use of benzotriazole antifoggants. A further preferred class of organic antifoggants are the mercapto azole antifoggants. Inorganic antifoggants or restrainers, such as alkali metal bromides, can be utilized in conjunction with the use of an organic antifoggant, if desired.

Particularly preferred benzotriazole antifoggants for use in the developing solutions of this invention are benzotriazole, halo-substituted benzotriazoles such as 4-chlorobenzotriazole; 4-bromobenzotriazole and 5-chlorobenzotriazole, and alkyl-substituted benzotriazoles such as 5-methylbenzotriazole.

Preferred mercapto azole antifoggants are those represented by the formula:

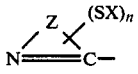

wherein Z represents the atoms necessary to complete a 5 or 6 member heterocyclic ring, such as pyrimidine, triazine, tetrazole, triazole, imidazole, diazole, oxadiazole or thiadiazole ring; and SX represents a mercapto function, n being a whole number, typically a number from 1 to about 3, any free bonds being satisfied by hydrogen atoms. In the mercapto function or group, X is a cation which includes hydrogen, an alkali metal, e.g., sodium or potassium, ammonium or an organic amine residue of such amines as triethyl amine, triethanol amine, morpholine and the like.

Mercapto tetrazole antifoggants are especially suitable in the practice of this invention and include those of the formula:

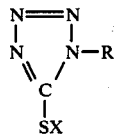

wherein R is an aliphatic or aromatic radical containing up to about 30 carbon atoms and SX is a mercapto function.

Specific examples of mercapto azole antifoggants include:

mercapto-substituted pyrimidines such as:
thiobarbituric acid and
thiouracil,
mercapto-substituted oxadiazoles or thiadiazoles such as:
5-phenyl-2-mercapto-1,3,4-oxadiazole and
5-o-tolyl-2-mercapto-1,3,4-thiadiazole,
mercapto triazines such as: 2,4,6-trimercapto-1,3,5-triazine,
mercapto imidazoles such as: 2-mercapto-5-phenylimidazole,
condensed imidazoles such as: 2-mercaptobenzimidazole, triazoles such as:
3,4-diphenyl-5-mercapto-1,2,4-triazole and
3-mercapto-5-methyl-1,2,4-triazole,
mercapto tetrazoles such as:
1-phenyl-5-mercaptotetrazole and
1-(3-capramido)phenyl-5-mercaptotetrazole.

Photographic elements processed in the aqueous alkaline developing solutions of this invention comprise one or more layers formed from a negative-working silver halide emulsion comprised of a binder and radiation-sensitive silver halide grains capable of forming a surface latent image. The useful silver halide emulsions include the high chloride emulsions conventionally employed in forming "lith" photographic elements as well as silver bromide and silver bromoiodide emulsions, which are recognized in the art to be capable of attaining higher photographic speeds. Generally, the iodide content of the silver halide emulsions is less than about 10 mole percent silver iodide, based on total silver halide.

The silver halide grains of the emulsions are capable of forming a surface latent image, as opposed to being of the internal latent image-forming type. Surface latent image silver halide grains are employed in the overwhelming majority of negative-working silver halide emulsions, whereas internal latent image-forming silver halide grains, though capable of forming a negative image when developed in an internal developer, are usually employed with surface developers to form direct-positive images. The distinction between surface latent image and internal latent image silver halide grains is generally well recognized in the art. Generally, some additional ingredient or step is required in preparation to form silver halide grains capable of preferentially forming an internal latent image as compared to a surface latent image.

The silver halide emulsions can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

In addition to the essential components specified hereinabove, the developing solutions of this invention can optionally contain any of a wide variety of addenda known to be useful in photographic developing compositions. For example, they can contain solvents, buffers, sequestering agents, development accelerators, agents to reduce swelling of the emulsion layers, and the like.

In processing photographic elements with the developing solutions described herein, the time and temperature employed for development can be varied widely. Typically, the development temperature will be in the range of from about 20° C. (68° F.) to about 50° C. (122° F.), more preferably in the range of from about 25° C. (77° F.) to about 40° C. (104° F.), while the development time will be in the range of from about 10 seconds to about 150 seconds, more preferably in the range of from about 60 seconds to about 120 seconds.

The invention is further illustrated by the following examples of its practice.

EXAMPLES 1–9

A 0.4 micron cubic silver bromoiodide emulsion containing 2.5 mole percent iodide was coated on a polyester film support at 250 mg/ft$^2$ (2.7 g/m$^2$) gelatin and 400 mg/ft$^2$ (4.32 g/m$^2$) silver. The emulsion contained the sensitizing dye anhydro-5,5-dichloro-9-ethyl-3,3'-bis(3-sulfopropyl)oxacarbocyanine hydroxide-sodium salt at a concentration of 216 mg per mole of silver, the hydrazine compound 1-formyl-2-{4-[2-(2,4-di-t-pentylphenoxy)butyramido]phenyl}hydrazide at a concentration of 1.0 grams per mole of silver, polyethylene glycol at 253 mg/mole silver, 2% saponin spreading agent, and 200 mg/ft$^2$ (2.16 g/m$^2$) of a terpolymer of methyl acrylate, 2-acrylamido-2-methylpropane sulfonic acid and 2-acetoacetoxyethyl methacrylate. The emulsion layer was protected by a hardened overcoat containing 200 mg/ft$^2$ (2.16 g/m$^2$) of gelatin hardened with 1.2% bis-vinylsulfonylmethyl ether hardener and 2% saponin spreading agent.

Samples of the film prepared as described above were exposed for one second to a 500 watt, 3200° K. tungsten light source through a 0.8 neutral density filter. The test object used was a continuous carbon wedge (0 to 3.0 density) partly covered with a 133 line/inch gray negative, elliptical dot screen. The exposed samples were processed in an aqueous alkaline developing solution of the composition described below for 30, 60, 90 or 120 seconds at 90° F., using the developing time necessary in each instance to achieve maximum contrast with a minimum fog level. After development, the samples were fixed, washed and dried.

In each case, the developing solution contained 75.0 grams/liter of $Na_2SO_3$, 7.0 grams/liter of $NaHCO_3$, 40.0 grams/liter of hydroquinone, 0.4 grams/liter of 1-phenyl-4,4-dimethyl-3-pyrazolidone, 3.0 grams/liter of NaBr, 0.8 grams/liter of 5-methylbenzotriazole and 1.0 grams/liter of the disodium salt of ethylenediaminetetraacetic acid. In each of Control Tests 1, 2, 3 and 4, the developing solution contained 34.8 grams/liter of KOH to provide a pH of 11.3, while in Control Test 5 the developing solution contained 44.3 grams/liter of KOH to provide a pH of 12.0. In each of Examples 1 to 9, the developing solution contained KOH and an amino compound, added as a contrast-promoting agent, as specified in Table I below. The amount of KOH employed in each of Examples 1 to 9 was sufficient to provide, together with the amino compound, a pH of 11.3.

TABLE I

| Example No. | Amino Compound | Concentration of Amino Compound (grams/liter) | Development Time (seconds) | Gross Fog | Relative[1] Speed | Average[2] Contrast |
|---|---|---|---|---|---|---|
| Control Test 1 | — | — | 120 | 0.03 | 0.00 | 3.23 |
| Control Test 2 | — | — | 90 | 0.03 | −0.03 | 3.13 |
| Control Test 3 | — | — | 60 | 0.03 | −0.06 | 3.13 |
| Control Test 4 | — | — | 30 | 0.03 | −0.08 | 2.94 |
| Control Test 5 | — | — | 120 | 0.03 | +0.59 | 16.67 |
| 1 | 3-diethylamino-1-propanol | 45 | 120 | 0.03 | +0.84 | 12.50 |
| 2 | 2-methylamino-1-ethanol | 200 | 120 | 0.06 | +0.52 | 3.57 |
| 3 | 2-diethylamino-1-ethanol | 130 | 60 | 0.06 | +0.94 | 11.11 |
| 4 | diisopropylamine | 30 | 60 | 0.03 | +0.55 | 10.00 |
| 5 | diethylamine | 30 | 60 | 0.03 | +0.57 | 11.11 |
| 6 | 5-amino-1-pentanol | 50 | 30 | 0.04 | +0.55 | 4.00 |
| 7 | 5-amino-1-pentanol | 30 | 90 | 0.05 | +0.66 | 14.28 |
| 8 | 6-amino-1-hexanol | 30 | 30 | 0.07 | +0.63 | 3.57 |
| 9 | 6-amino-1-hexanol | 10 | 120 | 0.03 | +0.67 | 11.11 |

[1]Speeds reported are comparisons to a relative speed of 1.0 for Control Test 1.
[2]Average contrast values reported were determined by measuring the slope of the characteristic curve between two points located at densities of 0.5 above $D_{min}$ and 1.5 above $D_{min}$.

Considering the data reported in Table I, it is seen that with Control Tests 1 through 4, in which the developing solution had a pH of 11.3 and did not contain a contrast-promoting amino compound, high contrast values were not obtained, as the contrasts ranged from 2.94 to 3.23. These control tests demonstrate that without the use of a contrast-promoting amount of an amino compound, high contrast is not obtained at a pH of 11.3, even though a hydrazine compound is employed. With Control Test 5, in which the developing solution did not contain a contrast-promoting amino compound but had a pH of 12.0, a high contrast of 16.67 was obtained. Examples 1 through 9 all had the same pH of 11.3 as was used in Control Tests 1 through 4. However, relatively high contrasts, in the range of 10.00 to 14.28 were obtained in Examples 1, 3, 4, 5, 7, and 9, thereby demonstrating the effectiveness of the amino compounds as contrast-promoting agents. Thus, for example, the only difference between Example 1 and Control Test 1 is the presence of 45 grams per liter of 3-diethylamino-1-propanol in the developing solution in Example 1, yet the contrast is 12.50 in Example 1 as compared to only 3.23 in Control Test 1. Comparison of Examples 6 and 7 indicates that, with 5-amino-1-pentanol, high contrast is achieved with a concentration of 30 grams per liter and a development time of 90 seconds, but not with a concentration of 50 grams per liter and a development time of 30 seconds. Comparison of Examples 8 and 9 indicates that with 6 amino-1-hexanol high contrast is achieved with a concentration of 10 grams per liter and a development time of 120 seconds, but not with a concentration of 30 grams per liter and a development time of 30 seconds. Example 2 indicates that high contrast was not obtained with 2-methylamino-1-ethanol at the particular concentration and development time evaluated. These results demonstrate the need to properly select both concentration of amino compound and development time to achieve optimum results. Such selection is readily made by carrying out a few routine experiments.

EXAMPLES 10–30

The photographic film described in the examples above was exposed in the same manner as is described above. Samples of the film were developed at 90° F. in an aqueous alkaline developing solution of the composition described below, fixed, washed, and dried.

In each case, the developing solution contained 500 milliliters per liter of a 0.8 molar solution of phosphoric acid, 1.0 grams/liter of the disodium salt of ethylenediaminetetraacetic acid, 60.0 grams/liter of $Na_2SO_3$, 0.15 grams/liter of 5-methylbenzotriazole, 30.0 grams/liter of hydroquinone, 0.40 grams/liter of 1-phenyl-4-methyl-4-hydroxymethyl-3-pyrazolidone and 3.0 grams/liter of NaBr. In each of Control Tests 1A, 2A, 3A, and 4A, the developing solution also contained sufficient NaOH to provide a pH of 11.25, while in Control Tests 5A and 6A the developing solution contained sufficient NaOH to provide a pH of 12.00. In each of Examples 10 to 30, the developing solution contained NaOH and an amino compound, added as a contrast-promoting agent, as specified in Table II below. The amount of NaOH employed in each of Examples 10 to 30 was sufficient to provide, together with the amino compound, a pH of 11.25.

TABLE II

| Example No. | Amino Compound | Concentration of Amino Compound (grams/liter) | Development Time (seconds) | Gross Fog | Relative[1] Speed | Average[2] Contrast |
|---|---|---|---|---|---|---|
| Control Test 1A | — | — | 120 | 0.07 | 0.00 | 3.23 |
| Control Test 2A | — | — | 90 | 0.07 | −0.03 | 3.13 |
| Control Test 3A | — | — | 60 | 0.07 | −0.04 | 3.13 |
| Control Test 4A | — | — | 30 | 0.07 | −0.07 | 2.94 |
| Control Test 5A | — | — | 60 | 0.11 | +0.56 | 12.50 |
| Control Test 6A | — | — | 30 | 0.08 | +0.21 | 2.86 |
| 10 | 2-diethylamino-1- | | | | | |

TABLE II-continued

| Example No. | Amino Compound | Concentration of Amino Compound (grams/liter) | Development Time (seconds) | Gross Fog | Relative[1] Speed | Average[2] Contrast |
|---|---|---|---|---|---|---|
| | ethanol | 20 | 120 | 0.07 | +0.53 | 33.30 |
| 11 | 2-diethylamino-1-ethanol | 20 | 90 | 0.07 | +0.50 | 25.00 |
| 12 | 2-diethylamino-1-ethanol | 20 | 60 | 0.07 | +0.43 | 16.67 |
| 13 | 3-diethylamino-1-propanol | 20 | 90 | 0.07 | +0.56 | 28.57 |
| 14 | 3-diethylamino-1-propanol | 20 | 60 | 0.07 | +0.50 | 20.00 |
| 15 | 3-diethylamino-1-propanol | 20 | 30 | 0.07 | +0.37 | 14.29 |
| 16 | p-methylaminophenol sulfate | 40 | 360 | 0.09 | +0.06 | 2.94 |
| 17 | p-methylaminophenol sulfate | 40 | 120 | 0.08 | +0.02 | 2.94 |
| 18 | ethylenediamine-tetraacetic acid | 20 | 120 | 0.06 | −0.05 | 2.85 |
| 19 | ethylenediamine-tetraacetic acid | 40 | 120 | 0.06 | −0.06 | 3.13 |
| 20 | ethylenediamine-tetraacetic acid | 80 | 120 | 0.06 | −0.07 | 2.94 |
| 21 | 2-methylamino-1-ethanol | 20 | 120 | 0.06 | +0.10 | 3.03 |
| 22 | 2-methylamino-1-ethanol | 40 | 120 | 0.06 | +0.22 | 3.33 |
| 23 | 2-methylamino-1-ethanol | 80 | 120 | 0.06 | +0.57 | 8.33 |
| 24 | 4-(2-aminoethyl) morpholine | 5 | 120 | 0.03 | +0.29 | 8.33 |
| 25 | 1-(2-aminoethyl) piperazine | 5 | 120 | 0.03 | +0.22 | 4.00 |
| 26 | polyethyleneimine | 5 | 60 | 0.19 | +0.38 | 3.84 |
| 27 | 1,4-cyclohexanebis (methylamine) | 1 | 120 | 0.04 | +0.48 | 16.67 |
| 28 | Quinuclidine | 20 | 120 | 0.07 | +0.53 | 25.00 |
| 29 | Triethylamine | 5 | 120 | 0.06 | +0.42 | 20.00 |
| 30 | Triethylamine | 10 | 120 | 0.06 | +0.53 | 25.00 |

[1]Speeds reported are comparisons to a relative speed of 1.0 for Control Test 1A.
[2]Average contrast values reported were determined by measuring the slope of the characteristic curve between two points located at densities of 0.5 above $D_{min}$ and 1.5 above $D_{min}$.

Considering the data reported in Table II, it is seen that with Control Tests 1A through 4A, in which the developing solution had a pH of 11.25 and did not contain a contrast-promoting amino compound, high contrast values were not obtained. With Control Test 5A, in which the developing solution did not contain a contrast promoting amino compound but had a pH of 12.00, a high contrast of 12.50 was obtained. In Control Test 6A, the pH was also 12.00, but the development time employed was too short to give high contrast. Examples 10 through 30 all had the same pH of 11.25 as was used in Control Tests 1A through 4A. High contrasts were obtained in many of these examples, thereby demonstrating the effectiveness of the amino comounds as contrast-promoting agents. High contrast was not obtained by use of ethylenediaminetetraacetic acid in Examples 18, 19 and 20, nor by use of p-methylaminophenol sulfate in Examples 16 and 17. These compounds function, respectively, as a sequestering agent and a developing agent, and it may be because of these functional characteristics that they did not provide substantial improvement in contrast. The compounds 4-(2-aminoethyl)morpholine, 1-(2-aminoethyl)piperazine and polyethyleneimine, utilized, respectively, in Examples 24, 25 and 26, were also tested at a concentration of 50 grams/liter, but at this concentration, excessive fog resulted.

EXAMPLES 31 AND 32

A photographic film which was the same as that described in the examples above except that it did not contain a hydrazine compound was exposed in the same manner as described above. Samples of the film were developed at 90° F. in an aqueous alkaline developing solution of the composition described below, fixed, washed, and dried.

In each of Control Tests 1B and 2B, the developing solution contained 500 milliliters per liter of a 0.8 molar solution of phosphoric acid, 1.0 grams/liter of the disodium salt of ethylenediaminetetraacetic acid, 60.0 grams/liter of $Na_2SO_3$, 0.15 grams/liter of 5-methylbenzotriazole, 30.0 grams per liter of hydroquinone, 0.40 grams/liter of 1-phenyl-4-methyl-4-hydroxymethyl-3-pyrazolidone, 3.0 grams/liter of NaBr, 20 grams/liter of 2-diethylamino-1-ethanol and sufficient NaOH to give a pH of 11.25. In Example 31, the developing solution was the same as that used in Control Tests 1B and 2B, except that it additionally contained 0.05 grams/liter of p-(beta-methylsulfonamidoethyl)phenylhydrazine sulfate. In Example 32, the developing solution was the same as that used in Control Tests 1B and 2B, except that it additionally contained 0.10 grams/liter of hydrazine. Results obtained are reported in Table III.

TABLE III

| Example No. | Development Time (seconds) | Gross Fog | Relative[1] Speed | Average[2] Contrast |
|---|---|---|---|---|
| Control Test 1B | 120 | 0.04 | 0.00 | 2.70 |
| Control Test 2B | 300 | 0.04 | +0.03 | 2.70 |
| 31 | 120 | 0.04 | +0.56 | 9.09 |
| 32 | 120 | 0.05 | +0.67 | 20.00 |

[1]Speeds reported are comparisons to a relative speed of 1.0 for Control Test 1B.
[2]Average contrast values reported were determined by measuring the slope of the characteristic curve between two points located at densities of 0.5 above $D_{min}$ and 1.5 above $D_{min}$.

Considering the data reported in Table III, it is seen that high contrast values were not obtained in Control Tests 1B and 2B, even though the developing solution contained 20 grams/liter of 2-diethylamino-1-ethanol. This is explained by the fact that there was no hydrazine compound present in either the film or the developing solution. In Examples 31 and 32, which had the same pH of 11.25 as was utilized in Control Tests 1B and 2B, much higher contrast values were achieved as a result of the fact that the developing solution contained both a hydrazine compound and a contrast-promoting amount of an amino compound.

The overall conclusion that can be drawn from the results of Examples 1 to 32 is that, by use of amino compounds, high contrast can be achieved with stable high sulfite developing solutions at a pH low enough for the effective lifetime of the developing solution to be significantly improved.

The present invention has many important advantages as compared to the conventional use of "lith" developers to obtain high contrast. For example, the combination of a 3-pyrazolidone developing agent with a dihydroxybenzene developing agent provides increased developer capacity and reduced induction time as compared to a conventional "lith" developer, which utilizes only a dihydoxybenzene developing agent. The requirement in "lith" developers to maintain a low sulfite ion concentration to avoid interference with hydroquinone oxidation products and resulting prevention of "infectious development" does not apply to the developers of this invention, so that levels of sulfite preservative sufficient to provide a high degree of protection against aerial oxidation can be used. Whereas "lith" developers are typically utilized only with high chloride emulsions, the developers of this invention can be used with other types of emulsions, such as silver bromoiodide emulsions, to thereby achieve such advantages as higher photographic speeds. Use of a moderate pH level, such as a pH of 11, is feasible with this invention, so that the developer solution also has the highly desirable attribute of a long effective life.

The invention has been described in detail with particular reference to preferred embodiments thereof, but it will be understood that variations and modifications can be effected within the spirit and scope of the invention.

I claim:

1. A method for high contrast development of a photographic element comprising at least one silver halide emulsion layer, which method comprises contacting said element in the presence of a hydrazine compound with an aqueous alkaline developing solution which has a pH of above 10 and below 12 and contains a dihydroxybenzene developing agent, a 3-pyrazolidone developing agent, a sulfite preservative, and a contrast-promoting amount of an amino compound.

2. A method for high contrast development of a photographic element comprising at least one silver halide emulsion layer containing a hydrazine compound, which method comprises contacting said element with an aqueous alkaline developing solution which has a pH of above 10 and below 12 and contains a dihydroxybenzene developing agent, a 3-pyrazolidone developing agent, a sulfite preservative, and a contrast-promoting amount of an amino compound.

3. A method for high contrast development of a photographic element comprising at least one silver halide emulsion layer, which method comprises contacting said element with an aqueous alkaline developing solution which has a pH of above 10 and below 12 and contains a hydrazine compound, a dihydroxybenzene developing agent, a 3-pyrazolidone developing agent, a sulfite preservative, and a contrast-promoting amount of an amino compound.

4. A method as claimed in claim 1 wherein said develping solution has a pH in the range of from 10.8 to 11.4.

5. A method as claimed in claim 1 wherein said dihydroxybenzene developing agent is hydroquinone.

6. A method as claimed in claim 1 wherein said 3-pyrazolidone developing agent is 1-phenyl-3-pyrazolidone.

7. A method as claimed in claim 1 wherein said 3-pyrazolidone developing agent is 1-phenyl-4-methyl-4-hydroxymethyl-3-pyrazolidone.

8. A method as claimed in claim 1 wherein said 3-pyrazolidone developing agent is 1-phenyl-4,4-dimethyl-3-pyrazolidone.

9. A method as claimed in claim 1 wherein said sulfite preservative is sodium sulfite.

10. A method as claimed in claim 1 wherein said amino compound is an alkanolamine.

11. A method as claimed in claim 1 wherein said amino compound is an alkylamine.

12. A method as claimed in claim 1 wherein said amino compound is an alkanolamine of the formula:

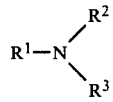

wherein $R^1$ is an hydroxyalkyl group of 2 to 10 carbon atoms, and each of $R^2$ and $R^3$ is a hydrogen atom, an alkyl group of 1 to 10 carbon atoms, an hydroxyalkyl group of 2 to 10 carbon atoms, a benzyl radical, or a

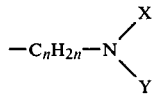

group wherein n is an integer of from 1 to 10 and each of X and Y is a hydrogen atom, an alkyl group of 1 to 10 carbon atoms, or an hydroxyalkyl group of 2 to 10 carbon atoms.

13. A method as claimed in claim 1 wherein said amino compound is an alkyl amine of the formula:

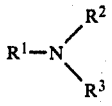

wherein $R^1$ is an alkyl group of 1 to 10 carbon atoms and each of $R^2$ and $R^3$ is a hydrogen atom or an alkyl group of 1 to 10 carbon atoms.

14. A method as claimed in claim 1 wherein said amino compound is 2-diethylamino-1-ethanol.

15. A method as claimed in claim 1 wherein said amino compound is 3-diethylamino-1-propanol.

16. A method as claimed in claim 1 wherein said developing solution additionally contains a benzotriazole antifoggant.

17. A method as claimed in claim 1 wherein said developing solution additionally contains 5-methyl-benzotriazole.

18. A method for high contrast development of a photographic element comprising at least one silver halide emulsion layer containing 1-formyl-2-{4-[2-(2,4-di-t-pentylphenoxy)butyramido]phenyl}hydrazide, which method comprises contacting said element with an aqueous alkaline developing solution which has a pH in the range of from 10.8 to 11.4 and contains hydroquinone, 1-phenyl-4,4-dimethyl-3-pyrazolidone, sodium sulfite, and a contrast-promoting amount of 2-diethylamino-1-ethanol.

19. An aqueous alkaline photographic developing solution for use in high contrast processing of photographic elements, said solution having a pH of above 10 and below 12 and containing a hydrazine compound, a dihydroxybenzene developing agent, a 3-pyrazolidone developing agent, a sulfite preservative, and a contrast-promoting amount of an amino compound.

20. An aqueous alkaline developing solution as claimed in claim 19 having a pH in the range of from 10.8 to 11.4.

21. An aqueous alkaline developing solution as claimed in claim 19 wherein said amino compound is an alkanolamine.

22. An aqueous alkaline developing solution as claimed in claim 19 wherein said amino compound is an alkyl amine.

23. An aqueous alkaline developing solution as claimed in claim 19 wherein said amino compound is an alkanolamine of the formula:

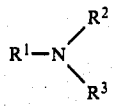

wherein $R^1$ is an hydroxyalkyl group of 2 to 10 carbon atoms, and each of $R^2$ and $R^3$ is a hydrogen atom, an alkyl group of 1 to 10 carbon atoms, an hydroxyalkyl group of 2 to 10 carbon atoms, a benzyl radical, or a

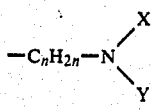

group wherein n is an integer of from 1 to 10 and each of X and Y is a hydrogen atom, an alkyl group of 1 to 10 carbon atoms, or an hydroxyalkyl group of 2 to 10 carbon atoms.

24. An aqueous alkaline developing solution as claimed in claim 19 wherein said amino compound is an alkyl amine of the formula:

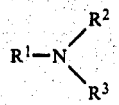

wherein $R^1$ is an alkyl group of 1 to 10 carbon atoms, and each of $R^2$ and $R^3$ is a hydrogen atom or an alkyl group of 1 to 10 carbon atoms.

25. An aqueous alkaline developing solution as claimed in claim 19 wherein said amino compound is 2-diethyl-amino-1-ethanol.

* * * * *